United States Patent [19]

Nagy

[11] Patent Number: 5,037,668

[45] Date of Patent: Aug. 6, 1991

[54] RADIATION CURE RELEASE COATINGS WITHOUT SILICONE

[75] Inventor: Frank A. Nagy, Flemington, N.J.

[73] Assignee: Mobil Oil Corporation, Fairfax, Va.

[21] Appl. No.: 452,075

[22] Filed: Dec. 18, 1989

[51] Int. Cl.[5] ..... B05D 3/06

[52] U.S. Cl. ..... 427/44; 156/230; 156/275.5; 264/22; 427/54.1; 427/155; 427/296

[58] Field of Search ..... 427/44, 54.1, 147, 148, 427/154, 155, 296; 156/230, 233, 238, 275.5; 264/22

[56] References Cited

U.S. PATENT DOCUMENTS 4,388,137 6/1983 McCarty et al. ..... 156/275.5

4,923,847 5/1990 Ito et al. ..... 427/256

*Primary Examiner*—Michael Lusignan

*Attorney, Agent, or Firm*—Alexander J. McKillop; Charles J. Speciale; Marina V. Schneller

[57] ABSTRACT

The invention relates to acrylate polymer and copolymer release coatings containing amounts of polyfluoropolymer powder sufficient to alter the adhesion of the release coating on a support after radiation curing of the formulation producing said coating.

11 Claims, No Drawings

RADIATION CURE RELEASE COATINGS WITHOUT SILICONE

FIELD OF THE INVENTION

The invention relates to radiation curable release coatings suitable for various release applications which are free of silicone release agents. The invention includes the formulation of polymerizable coating compositions and the cured coating film or sheet produced therefrom. The invention includes coating compositions useful for transfer coating applications.

BACKGROUND OF THE INVENTION

Radiation curable coatings differ in their adherence to the various plastic, metallic and paper substrates used in commerce. This difference in adherence can be applied to transferring a coating from one substrate having a relatively weak adhesive bond to a second substrate having a stronger bond.

One set of applications based on that concept is substitution of low cost substrates readily available in commerce for the expensive release substrates currently used for this purpose. Furthermore, the surface texture of the carrying web may be desirably imparted to the cured coating. In this way any of a number of aesthetically pleasing and decorative effects can be produced. In addition, when using a nonporous substrate as the carrying web for transfer of the coating composition to a porous substrate, the quantity of coating required is greatly reduced due to the minimization of wicking of the uncured coating into the porous substrate. The result is a coating which resides largely on the surface of the porous substrate, thus more easily bridging the irregularities of that surface with a minimum of coating material. A particularly good example of this process is the transfer of a coating composition from a polyester web to paper to provide a smooth glossy surface for subsequent vacuum metallization. The metallized surface obtained in this manner is exceptionally shiny and free from flaws and blemishes.

In alternative applications, the substrate can be used as interleaves between plastic sheets, temporary backings for pressure-sensitive adhesives, and papers used as temporary carriers in film and foam casting processes. The release papers may be smooth or embossed, to impart any desired texture to the film or the foam cast against them. They may also be preprinted with an ink that is transferred to the cast film.

SUMMARY OF THE INVENTION

The invention relates to providing a formulation which is free of silicone as a release agent, which is liquid, which is curable by electron beam or ultraviolet radiation and which contains at least 5.0 weight percent of polytetrafluoroethylene polymer in particulate form. The formulation comprises acrylo monomers and oligomers of both monofunctional and trifunctional acrylate monomers which can be conveniently cured by irradiation.

DETAILED DESCRIPTION OF THE INVENTION

The monomer containing formulations of the invention contain acrylate monomers and oligomers based on acrylates. The acrylate can be monofunctonal or trifunctional; these monomers can be cured by electron beam or ultraviolet radiation. The acrylate can be selected from the group consisting of methyl acrylate, ethyl acrylate, butyl acrylate, methylacrylate, ethyl acrylate, n-butyl acrylate, methyl methacrylate, ethyl methacrylate, n-butyl methacrylate, 1,4-butylene dimethacrylate. Oligomers which can be used as the acrylate source in formulations of the invention include acrylated epoxy resins (Bisphenol A type).

The formulations of the invention are solutions of the acrylate monomer. The solvents for the formulations can be selected from those including benzene, ethyl acetate, ethylene dichloride, butyl acetate, methyl isobutyl ketone, toluene and admixtures thereof. The solution formulation can contain 5 to 50 weight percent of monomer.

The formulation contains small amounts of fluoropolymer sufficient to facilitate removal of the cured coating of the formulation from a carrying web without adversely affecting the physical integrity of the cured coating. The amount of the fluoropolymer in the formulation can range from 2 to 10 weight percent. The fluoropolymer is in particulate form. The particule size of the fluoropolymer can range from 0.1 microns to 10 microns. The particule size of the fluoropolymer is such that the fluoropolymer is a powder. Preferably, the fluoropolymer is Teflon. Inclusion of the powder fluoropolymer obviates the art recognized expedient of employing lubricants referred to as internal lubricants which are used in release coatings to reduce the surface coefficient of friction. Thse art recognized internal lubricants include waxes, hydrocarbon oils, and silicones, which can detrimentally alter the physical properties of the cured coating.

In accordance with the invention the inclusion of the fluoropolymer powder in the formulation of the invention reduces the surface coefficient of friction. Accordingly, that inclusion has been found useful to control, generally to reduce, the adhesive force of the cured coating, thereby facilitating removal therefrom of the carrying web. Care must be taken, however, not to incorporate an undue amount of such materials into the coating composition, as adhesion to the substrate of interest may be adversely affected and it may make the subsequent application of decorative inks or other materials to the cured coating more difficult.

The formulation of the invention which is rendered a radiation cured release coating is done so on a carrying web. The carrying web may be ordered according to the peel force required to separate it from the substrate of interest. In general, the carrying web may be a polyolefin, polyester, metal or paper used in commerce will perform well as carrying webs exhibiting low peel strength.

The desired physical, chemical and aesthetic properties of the coating required for the intended use on the substrate of interest is decided and a suitable formulation developed. Application of the coating to varous plastic, paper and metal film materials which might be useful as carrying webs is then performed. In accordance with the invention, the coated carrying web may be brought into contact with an ultimate substrate of interest.

If the film or sheet produced by radiation curing in accordance with the invention is to be simultaneously, with said curing, adhered to a substrate, other than the carrying web, a sandwich of said other substrate, said carrying web and the formulation of the invention disposed therebetween is formed. In such an application the adhesive force between the cured coating and the substrate of interest may be modified. An initial consideration to such modification is the crosslink density of the coating composition, as conveniently defined by the calculated (i.e., theoretically possible) number of gram moles of potential branch points per 100 grams of coating composition; one may controllably effect a decrease in the adhesive bond strength between the cured coating and most substrates of interest in commerce. Crosslink densities ranging from about 0.02 to about 1.0 have been found to be useful in this regard, but a range of from about 0.03 to 0.7 is preferred and, in particular, a range of between 0.04 and 0.5 is found to be the most useful. Given a calculated potential crosslink density in the coating composition, the adhesive force between the cured coating and the substrate of interest may be further modified by incorporating into or eliminating from the composition specific chemical groups that influence the adhesive bond to the substrate. Such chemical groups may be broadly classified as Lewis & Bronsted acids or bases, hydroxyl or carboxyl groups combined with organic hydrocarbon molecules, ether linkages, urethane linkages, epoxide groups, and mercaptan groups. Incorporation of adhesion promoting groups on the surface of the substrate on which the cured coating is to remain after stripping away of the carrying web can be undertaken. This may be accomplished by subjecting the substrate of interest to oxidizing or reducing atmospheres, or by any other suitable chemical or heat treatment. Physical treatment of the surface of the uncoated substrate with abrasives which serve to improve mechanical adhesion may also be used on nonporous substrates to improve the adhesive bond.

Increasing the crosslink density of the coating will provide lower stripping forces and a correspondingly greater variety of carrying webs. Decreasing the crosslink density will have the opposite effect. In any specific process it is desirable that a compromise between adhesion to the substrate and the carrying web be reached.

The preferred range of crosslink densities described above provides coatings that demonstrate good adhesion to paper and vinyl film, while releasing acceptably from polyolefin, polyester, and "oil" metal films. The lower portion of the range also includes compositions that adhere well to treated polyethylene and clean metals, while stripping easily from polyolefin, polyester and "oily" metal films.

The order in the array may be altered by surface treatment. For example, if it is desired to transfer from polyester to polyethylene or metal films, the polyethylene may be subjected to Corona discharge, or the metal film may be cleansed of the oils and soaps used in the manufacturing process by suitable washing, heating treatment, or by Corona discharge treatment.

The coated carrying web or the sandwich formed thereby is then subjected to appropriate curing means (electron beam or UV) and the coating composition polymerized. In case of cure by electron beam, the composition of the carrying web is not critical since penetration by the electrons can be assured by selection of sufficiently high voltage. In the case of cure by ultraviolet light, however, the selection of carrying web must be confined to films that transmit UV light in sufficient intensity to effect the cure of the coating. Thus, polyolefins, particularly polyethylene, are preferred for use with UV cure coatings due to the excellent transmission of UV light. The range of materials tha can be used as carrying webs can be extended by using UV initiators that absorb strongly in regions where UV transmission is highest. Thus, polyester film can be used with UV cure coatings by use of photo initiators such as 2-chlorothioxanthose which absorbs light at the higher wavelengths. In addition, mixtures of molecules containing one or more epoxide groups per molecule may be cured by ultraviolet light using appropriate UV sensitive initiators. Such initiators are well known in the coating art. It is found that polyethylene is a particularly efficient carrying web for use with coatings compositions utilizing the epoxide cure mechanism.

The invention is illustrated by the following examples:

EXAMPLES

An electron beam (EB) curable binder containing oligomers based on acrylated epoxy resin (Bisphenol A type) and both monofunctional and trifunctional acrylate monomers which can be conveniently EB cured at 3 Mrads in an inert atmosphere to a crosslinked film served as the coating binder for this example. Small amounts of finely divided flouropolymer (about 5%) can be conveniently dispersed into the coating. Drawdowns onto 42 lb. super calendared paper applying about 3#/Ream (3 g/1000 sq. in.) (5 g/meter$^2$) could be EB cured using an ESI Lab Electrocurtain. Subsequent testing of the release properties of the EB cured coatings gave the following table:

| COATING COMPOSITION | RELEASE g/in MAGIC TAPE | PSA LABEL |
|---|---|---|
| Goldschmidt RC-450 100% silicone | 20 | 30 |
| V-26 base sol'n, 100% acrylate-no additive | paper tear | paper tear |
| V-26A 5% SST-3 Teflon powder | 60 | 50 |
| V-26C 5% Flourolube F Teflon powder | 15 | 50 |
| V-26D 5% Silicone blend - No Teflon | 80 | paper tear |

As shown, the addition of as little as 5% finely divided fluoropolymer gives the release properties to a 100% acrylate based silicone free radiation cured coating. Fluorolube F is also a Teflon powder but is a much finer particle size.

Obviously, with proper photo initiators, these same coatings could be cured with Ultra Violet light with similar results.

What is claimed is:

1. A process for forming a release sheet comprising providing a carrying web and applying to the carrying web a formulation containing a solution of a radiation curable source of an acrylate polymer or copolymer which formulation contains dispersed therein a polyfluoropolymer, in powder form, wherein the formulation contains said powder in an amount sufficient to facilitate removal of the cured formulation from said carrying web, wherein said formulation is free of silicone;

subjecting said coated web to a radiation curing process wherein said coating composition is polymerized and set on the surface of said carrying web; and stripping said carrying web away from the layer carrying said cured coating composition.

2. The process of claim 1, wherein said curing process comprises subjecting the coated web substrate to electron beam radiation and wherein said coating composition is curable by electron beam radiation.

3. The process of claim 1, wherein said curing process comprises subjecting the coated web substrate to ultraviolet radiation and wherein said coating composition is curable by ultraviolet radiation.

4. The process of claim 1, wherein said curing is undertaken in an inert atmosphere.

5. The process of claim 1, wherein said source of acrylate includes epoxy groups.

6. The process of claim 2, wherein said source of acrylate includes epoxy groups.

7. The process of claim 3, wherein said source of acrylate includes epoxy groups.

8. The process of claim 1, which further includes bringing a substrate to which said coating composition will adhere into contact with said coating composition on said carrying web to form a sandwich.

9. The process of claim 8 wherein said carrying web has a surface which has a predetermined texture, which texture will be transferred to the cured coated surface of said cured and coated substrate.

10. The process of claim 1 wherein said carrying web has a design to its surface to which said coating composition is applied, which design is transferred to the cured surface of said cured and coated substrate.

11. The process of claim 1, wherein the amount of powder ranges from 2 to 10 weight percent.

* * * * *